United States Patent [19]

Schreyer

[11] Patent Number: 5,038,172

[45] Date of Patent: Aug. 6, 1991

[54] PLAY-FREE BEARING MECHANISM FOR PHOTO-CONDUCTIVE DRUMS IN PRINTER OR COPIER DEVICES

[75] Inventor: Siegfried Schreyer, Glonn, Fed. Rep. of Germany

[73] Assignee: Siemens Aktiengesellschaft, Munich, Fed. Rep. of Germany

[21] Appl. No.: 442,329

[22] PCT Filed: Jan. 28, 1988

[86] PCT No.: PCT/DE88/00040

§ 371 Date: Oct. 5, 1989

§ 102(e) Date: Oct. 5, 1989

[87] PCT Pub. No.: WO88/05931

PCT Pub. Date: Aug. 11, 1988

[30] Foreign Application Priority Data

Feb. 9, 1987 [DE] Fed. Rep. of Germany ..... 3703942

[51] Int. Cl.[5] ..... G03G 5/00

[52] U.S. Cl. ..... 355/211; 29/123; 29/130

[58] Field of Search ..... 29/123, 130; 101/375, 101/378; 355/200, 210, 211

[56] References Cited

U.S. PATENT DOCUMENTS 3,926,515 12/1975 Nagahara .
4,120,576 10/1978 Babish ..... 29/123 X
4,134,667 1/1979 Schnall .
4,134,669 1/1979 Reitner .
4,527,883 7/1985 Kamiyama .

FOREIGN PATENT DOCUMENTS 2089753 1/1972 France .
0138778 10/1981 Japan ..... 355/211

*Primary Examiner*—A. T. Grimley
*Assistant Examiner*—Christopher Horgan
*Attorney, Agent, or Firm*—Hill, Van Santen, Steadman & Simpson

[57] ABSTRACT

The present invention discloses a bearing of a photo-conductive drum (10) in a non-mechanical printer and copier device that is free of bearing play while providing an easy replacement of. The photo-conductive drum, the photo-conductive drum (10) is guided between two drum receptacle flanges (14, 18) that comprise cone-shaped necks (16). One drum receptacle flange (14) is rigidly fixed to the drive shaft (13) of the photo-conductive drum (10) while the other (18) is removeably fashioned. A clamp mechanism, that can be screwed onto the drive shaft (13), provides a necessary positive and non-positive lock between photo-conductive drum (10) and the drum receptacle flanges (14, 18). Spreader elements (25), that connect the removable drum receptacle flange to the drive shaft in positive and non-positive fashion and as well as the drive shaft are situated between the drive shaft (13) and the removeable drum receptacle flange (18). The drive shaft (13) is seated at both sides, where one bearing (35) is removable and is fixed to an end shield (34) that covers the access region to the drum.

7 Claims, 2 Drawing Sheets

PLAY-FREE BEARING MECHANISM FOR PHOTO-CONDUCTIVE DRUMS IN PRINTER OR COPIER DEVICES

BACKGROUND OF THE INVENTION

1. Field of the Invention

The invention is directed to a mechanism for releasable fastening of a drum fashioned as intermediate carrier of a non-mechanical printer or copier device.

2. Description of the Prior Art

A prior art mechanism is disclosed by German published application 27 17 055 and corresponding U.S. Pat. No. 4,134,669 . In that mechanism, the photo-conductive drum includes turned-out cylindrical carriers at both ends that cooperate with corresponding necks of drum receptacle flanges that are arranged on the drive shaft. One drum receptacle flange is rigidly connected to the drive shaft while other can be detachably slipped onto the drive shaft via a through bore. A clamp mechanism that is screwed to the drive shaft presses the releasable drum receptacle flange resiliently against the drum which is then pressed against the stationary drum receptacle flange.

The concentric running precision of the photo-conductive drum that can be obtained with such a mechanism is dependent on the differential play between the drum receptacle flanges and the inside diameter of the photo-conductive drum, on the differential play between the through bore of the releasable drum receptacle flange and the drive shaft and on the actual concentricity precision of the drive shaft.

In printer equipment operating with intermediate carriers, such as electro-photographic printer equipment or magnetic printer equipment, a high concentricity precision of the drum-like intermediate carrier is extremely important for good print quality. This is particularly true when printing is to be carried out with a high character resolution. When a number of printed apparatuses are coupled together to produce multicolor printing or front and backside printing, the concentricity precisions of each printer apparatus participating in the printing add up.

SUMMARY OF THE INVENTION

It is an object of the invention to provide a mechanism for releasably fastening a photo-conductive drum such that a high concentricity precision is achieved while easy replaceability of the drum-shaped intermediate carrier is maintained. Damage to and deterioration of the surface of the drum-shaped intermediate carrier is avoided.

The object is achieved according to the principles of the present invention.

Spreader elements, that spread when the clamp mechanism is screwed to the drive shaft, are arranged between the drive shaft and the drum receptacle flange for centering the second, replaceably fashioned drum receptacle flange on the drive shaft. These spreader elements are composed, for example, of conical spring washers, the drum receptacle flange is exactly centered on the drive shaft and free of bearing play. Due to the additional measure of the conical design of the ends of the drum and of the drum receptacle flange, bearing play can not occur between the drum receptacle flanges and the drum.

In a preferred embodiment of the invention, the first drum receptacle flange is connected to the drive shaft via ribs that extend along the inside wall of the drum and are designed as pre-centering elements for the drum. These ribs penetrate through the replaceable drum receptacle flange at openings provided therefor, so that an easy replacement of the drum is possible when the drum receptacle flange is taken off. To avoid damage to the surface of the drum, it can first be put in place onto the rib-shaped pre-centering elements. The fine centering then ensues by screwing the clamp mechanism in and by clamping the drum between the drum receptacles flanges.

In another embodiment of the invention that also suppresses the concentricity imprecision of the drive shaft, the drive shaft is seated at both ends, via a bearing fixed to the housing at one end and via a removeable bearing at the other end. The bearing is advantageously arranged at the inside of an end shield that can be screwed to the housing. The built-in end shield is designed such that it covers the access region for the drum a completely dust-free and contact-proof fashion.

DETAILED DESCRIPTION OF THE DRAWINGS

DETAILED DESCRIPTION OF THE PREFERRED EMBODIMENT

Figure 1:
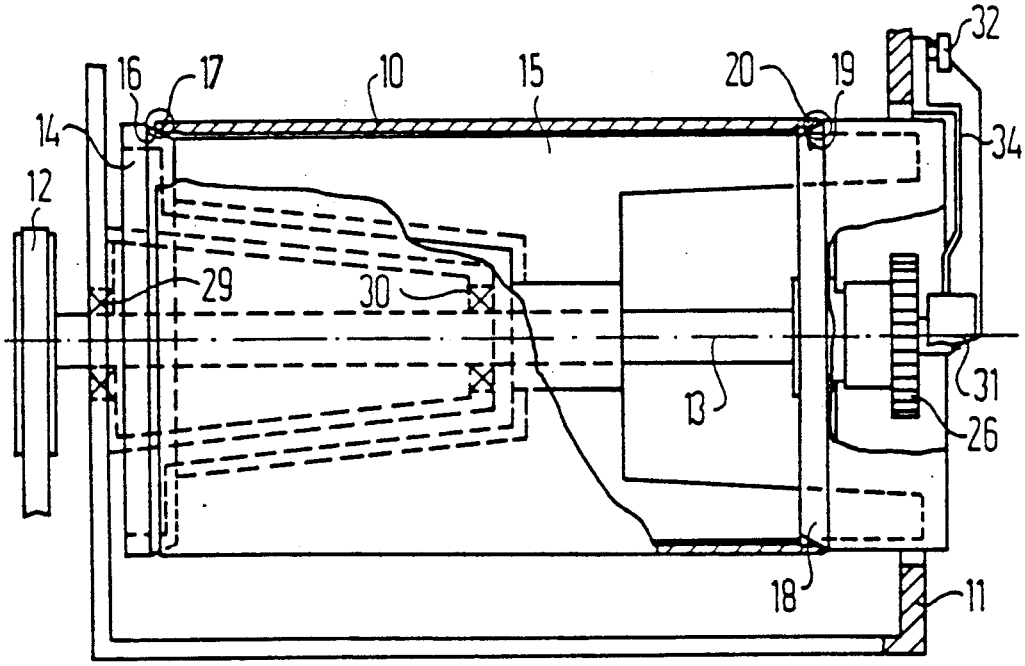
FIG. 1 is a partial cross-sectional view of a bearing mechanism for a photo-conductive drum in a printer device operating according to principles of the present invention.
Figure 2:
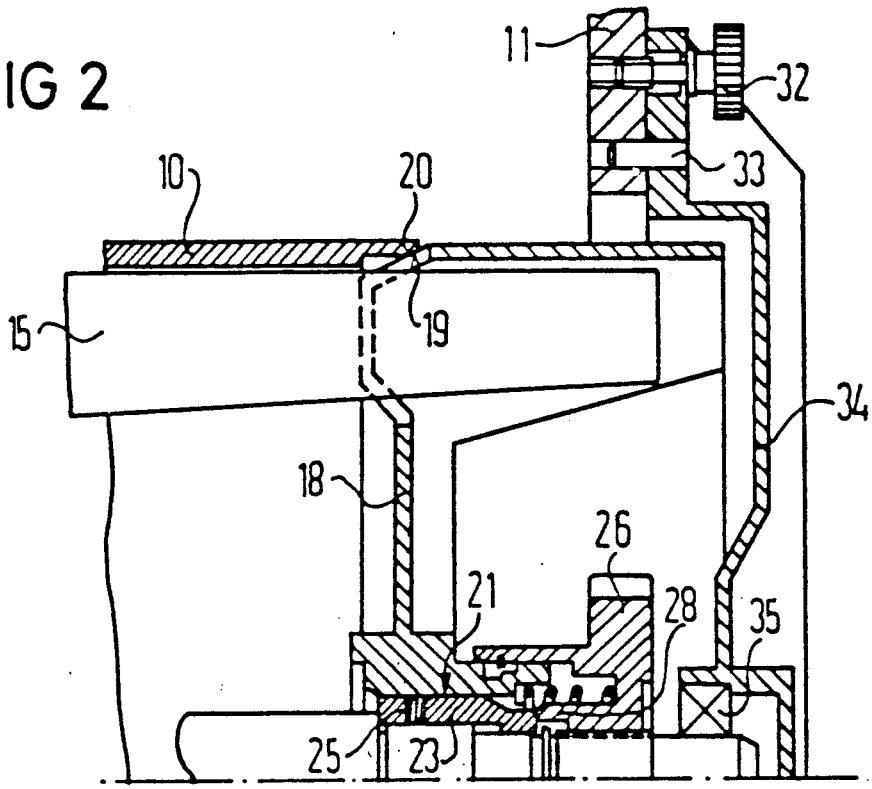
FIG. 2 is a cross sectional view of the bearing mechanism in the region of the deteachable drum receptacle flange, shown in the clamped condition of the clamp mechanism.

The printer mechanism shown in FIG. 1, operates according to the principle of electro-photography. The drum-shaped intermediate carrier, referred to as the photo-conductive drum 10, is rotatably seated in a housing carrier 11 of the apparatus and is motor-driven via a pulley 12 and a drive shaft 13. For bearing the photo-conductive drum 10, composed of a hollow cylinder that carries a photo-conductive layer at its outside, a first drum receptacle flange 14 is secured on the drive shaft 13 and is rigidly connected thereto. The first drum receptacle flange 14 includes ribs 15 that serve as pre-centering elements for the photo-conductive drum 10 and extend beyond the width of the phot-conductive drum 10. Further, the first drum receptacle flange 14 includes a cone-shaped neck 16 that cooperates with a corresponding cone-shaped carrier 17 of the photo-conductive drum 10. A second drum receptacle flange 18 detachably connected to the drive shaft 13 serves as abutment for the first drum receptacle flange, this second drum receptacle flange 18 also includes a cone-shaped neck 19 that in turn bear against a corresponding, cone-shaped carrier 20 of the other end of the photo-conductive drum 10. In FIG. 2, the second drum receptacle flange 18 includes a through-bore 21 and is supported on corresponding carriers 24 of the drive shaft 13 via an annular sleeve 22 and a thrust collar 23. Annular strain washers 25 are arranged between the annular sleeve 22 and the thrust collar 23. These annular strain washers 25 are capable of being spread over the trust collar 23 and, thus, centering the through-bore 21 of the second drum receptacle flange 18 on the drive shaft 13. A clamp mechanism that includes a handwheel 26 that can be screwed onto the drive shaft 13 is provided for detachably fastening the second drum receptacle flange 18. The handwheel 26 is secured on the second drum receptacle flange 18 via a a ring and is supported on the second drum receptacle flange 18 via a compression spring 27. A joining piece 28 presses against the thrust collar 23 during screw-in.

The drive shaft itself and, thus, the drum receptacle flanges are in the housing carrier 11 via, first, a stationary bearing composed of two bearing elements 29 and 30 and, second, via a detachable abutment 31. The abutment 31 is includes an end shield 34 detachably connectible to the housing carrier 11 via knurled screws 32 and centering pins 33. This end shield 34 has a ballbearing on its inner surface for bearing the drive shaft 13.

Proceeding from the functioning position shown in FIG. 3, an integration of the photo-conductive drum 10 is accomplished in the following way with the end shield 34 removed. First, the photo-conductive drum 10 is slipped onto the ribs 15 that serve as pre-centering elements and project up into the region of the housing carrier 11. The second drum receptacle flange 18 is then put in place and the clamp mechanism is screwed with the handwheel 26. Via the second drum receptacle flange 18, the compression spring 27 presses the photo-conductive drum 10 with its cone-shaped carriers 17 and 20 against the cone-shaped necks 16 and 19 of the first and second drum receptacle flanges. By screwing the clamp mechanism farther, the force onto the thrust collar 23 increases, pressing the annular strain washers 25 together, so that a positive lock and a non-positive lock between the drive shaft 13 and the second drum receptacle flange respectively, 18 is achieved. The maximum positive or, non-positive lock is achieved when the clamp mechanism is turned to a stop with the handwheel 26. Due to the force of the compression spring 27, moreover, a positive and non-positive lock between the photo-conductive drum 10 and the drum receptacle flanges is achieved via the cone-shaped elements 16, 17, 19, 20 of the first and second drum and of the photo-conductive drum 10 receptacle flanges 14 and 18 respective. After the handwheel is completely screwed in, the end shield 34 together with the ballbearing 35 is slipped onto the end of the drive shaft and is fixed via the knurled screws 32 and, the centering pins 33 according to the illustration in FIG. 2.

Figure 3:
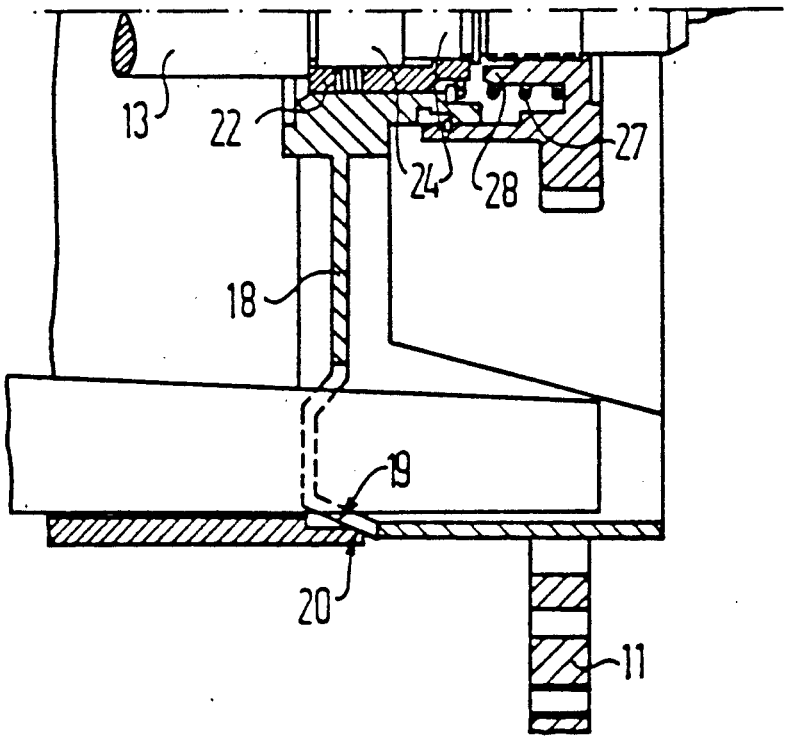
FIG. 3 is a cross sectional view of the bearing mechanism in the unclamped condition of the clamp mechanism.

In the described example of FIGS. 2 and 3, the spreader device is composed of annular strain washers 25 that are supported directly on the through-bore 21 of the second drum receptacle flange 18 and on the drive shaft 13. It is also possible to arrange a sleeve between the annular strain washers 25 and the through-bore 21 or, a sleeve between drive shaft 13 and annular strain washers 25. This sleeve can be used to avoid damage to the surface of the through-bore 21 and the drive shaft 13 or of the annular strain washers 25. It is also possible to employ Belleville spring washers instead of compression spring 27 or stain washers 25.

Although modifications and changes may be suggested by those skilled in the art, it is the intention of the inventors to embody within the patent warrented herein, all changes and modifications as reasonably and properly come within the contribution to the art.

I claim:

1. A mechanism for detachable fastening of a drum fashioned as an intermediate carrier of a non-mechanical printer or copier device to a drive shaft with a drum bearing, comprising:

a first drum receptacle flange that is rigidly arranged on said drive shaft, said first drum receptacle flange having an inner edge accepting a first free end of said drum, a second drum receptacle flange centered on said drive shaft, said second drum receptacle flange being moveable in an axial direction and having an inner edge accepting a second free end of said drum that is opposite said first free end, a clamp mechanism resiliently pressing the second drum receptacle flange against said drum which is in turn pressed against the first drum receptacle flange by being screwed to the drive shaft, and spreader elements that spread radially upon screwing of said clamp mechanism to the drive shaft, said spreader elements being arranged between said drive shaft and said second drum receptacle flange for centering said second receptacle flange on said drive shaft.

2. A mechanism according to claim 1, wherein said inner edge of said second drum receptacle flange and said second free end of said drum are conical in shape.

3. A mechanism according to claim 1, wherein said spreader elements are annular strain washers.

4. A mechanism according to claim 1, wherein said clamp mechanism comprises a thrust collar that actuates the spreader elements during screwing of said clamp mechanism.

5. A mechanism according to claim 1, wherein said first drum receptacle flange, is connected to said drive shaft via ribs fashioned as pre-centering elements for said drum and extending along an inside wall of said drum.

6. A mechanism according to claim 1, further comprising:

a housing in which said drive shaft is seated;

bearings rigidly attached to said housing and supporting said drive shaft in said housing; and a removable abutment supporting said drive shaft and being removable from said housing for replacing said drum.

7. A mechanism according to claim 6, wherein said abutment is arranged on one side of an end shield and is detachably connectible to said housing so that an end shield completely cover access to said drum when said clamp mechanism is attached.

* * * * *